US008201790B2

(12) United States Patent
Lin

(10) Patent No.: US 8,201,790 B2
(45) Date of Patent: Jun. 19, 2012

(54) ROLLER ROD ASSEMBLY FOR A SUNSHADE

(75) Inventor: Paul Lin, Yung-Kang (TW)

(73) Assignee: Macauto Industrial Co., Ltd., Tainan Hsien (TW)

( * ) Notice: Subject to any disclaimer, the term of this patent is extended or adjusted under 35 U.S.C. 154(b) by 224 days.

(21) Appl. No.: 12/793,903

(22) Filed: Jun. 4, 2010

(65) Prior Publication Data

US 2011/0297633 A1 Dec. 8, 2011

(51) Int. Cl.
*A47H 1/10* (2006.01)

(52) U.S. Cl. ..... 248/268; 248/254; 248/267; 160/323.1

(58) Field of Classification Search ..... 248/251, 248/252, 254, 261, 262, 264, 266, 267, 268; 160/323.1, 324, 325
See application file for complete search history.

(56) References Cited

U.S. PATENT DOCUMENTS 3,013,760 A * 12/1961 Anderson ..... 248/267
3,987,904 A * 10/1976 Height et al. ..... 211/105.1
4,009,745 A * 3/1977 Erpenbeck ..... 160/297
5,351,743 A * 10/1994 Jackson ..... 160/310
6,019,233 A * 2/2000 Yu ..... 211/87.01
6,935,401 B2 * 8/2005 Fraczek et al. ..... 160/321
7,549,458 B2 * 6/2009 Kwak ..... 160/319
7,677,293 B2 * 3/2010 Allsopp ..... 160/323.1
7,997,428 B2 * 8/2011 Goldstein ..... 211/105.3
2008/0121353 A1 * 5/2008 Detmer et al. ..... 160/266

* cited by examiner

*Primary Examiner* — Gwendolyn Baxter
(74) *Attorney, Agent, or Firm* — Pillsbury Winthrop Shaw Pittman, LLP

(57) ABSTRACT

A window blind includes a rod and a support unit. The support unit is disposed on an end portion of the rod, and includes an end cover, a fixing pillar, a support pillar, an inserting tube, and a metallic brace member. The end cover has an outer surface and an inner surface. The fixing pillar includes a rectangular pillar body having a pair of opposing wide faces and a pair of opposing narrow faces. The support pillar extends from the inner surface of the end cover and into the rod. The inserting tube is sleeved rotatably on the support pillar and inserted fixedly into the rod. The metallic brace member includes a ring portion, two wing portions, and two engaging portions.

5 Claims, 4 Drawing Sheets

ROLLER ROD ASSEMBLY FOR A SUNSHADE

BACKGROUND OF THE INVENTION

1. Field of the Invention

The present invention relates to a roller rod assembly, more particularly to a roller rod assembly for a sunshade.

2. Description of the Related Art

Referring to FIG. 1, a conventional roller rod assembly 1 is mounted to a horizontal frame 3, and includes a rod 11, a support component 12 disposed on one end portion of the rod 11 and which is removably engaged with the frame 3, and a brace member 13 disposed on the other end portion of the rod 11 and which abuts against and is removably engaged with the frame 3.

The support component 12 includes an end cover 121 covering said one end portion of the rod 11 and abutting against the frame 3, and an elastic pillar 122 disposed on the end cover 121 and extending into a hole 31 of the frame 3.

A curtain piece (not shown) mounted to the rod 11 can be pulled down from and rolled up on the rod 11.

Referring additionally to FIG. 2, the whole brace member 13 is made of plastic, and includes a cover 131, a fixing rectangular pillar 133, an axial pillar 135, an inserting tube 136, and two elastic pieces 137. The cover 131 covers said other end portion of the rod 11 and is disposed between the rod 11 and the frame 3. The fixing pillar 133 is disposed on an outer surface 132 of the cover 131, and extends into another hole 31 of the frame 31. The axial pillar 135 is disposed on an inner surface 134 of the cover 131 and extends into the rod 11. The inserting tube 136 is sleeved rotatably on the axial pillar 135 and is inserted fixedly into the rod 11. Each of the elastic pieces 137 extends from the cover 131 and abuts against the frame 3.

The elastic pieces 137 of the brace member 13 are used for alleviating and absorbing axial forces generated when the rod 11 is rotated. However, the elastic pieces 137 are made of plastic, and easily become brittle or lose their elasticity when subjected to low temperature conditions (such as −30° C.). When this occurs, the axial forces produced from the rotation of the rod 11 cannot be absorbed, and the rod 11 and the inserting tube 136 may press against the cover 131 with a significant force, such that the rod 11 and the inserting tube 136 become stuck and no longer able to rotate.

Moreover, if the elastic pieces 137 lose their ability to absorb the forces generated during rotation of the rod 11, the brace member 13 must be replaced, which is costly.

SUMMARY OF THE INVENTION

Therefore, the object of the present invention is to provide a roller rod assembly, which can be used under various temperature conditions and can be repaired by replacing components separately as needed.

Accordingly, a roller rod assembly of the present invention comprises a rod and a support unit.

The support unit is disposed on an end portion of the rod, and includes an end cover, a fixing pillar, a support pillar, an inserting tube, and a metallic brace member.

The end cover has an outer surface and an inner surface.

The fixing pillar extends from the outer surface of the end cover and includes a rectangular pillar body having a pair of opposing wide faces and a pair of opposing narrow faces. The wide faces are formed respectively with grooves at a location adjacent to the outer surface of the end cover to thereby form abutment surfaces opposing the outer surface.

The support pillar extends from the inner surface of the end cover and into the rod.

The inserting tube is sleeved rotatably on the support pillar, and is inserted fixedly into the rod.

The metallic brace member includes a ring portion having an inner circumferential surface and an outer circumferential surface and that is sleeved removably on the fixing pillar and abutted against the outer surface of the end cover, two wing portions each of which extends from the outer circumferential surface of the ring portion in a direction away from the support pillar, and two engaging portions that extend from the inner circumferential surface of the ring portion and that are disposed respectively in the grooves to abut respectively against the abutment surfaces.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
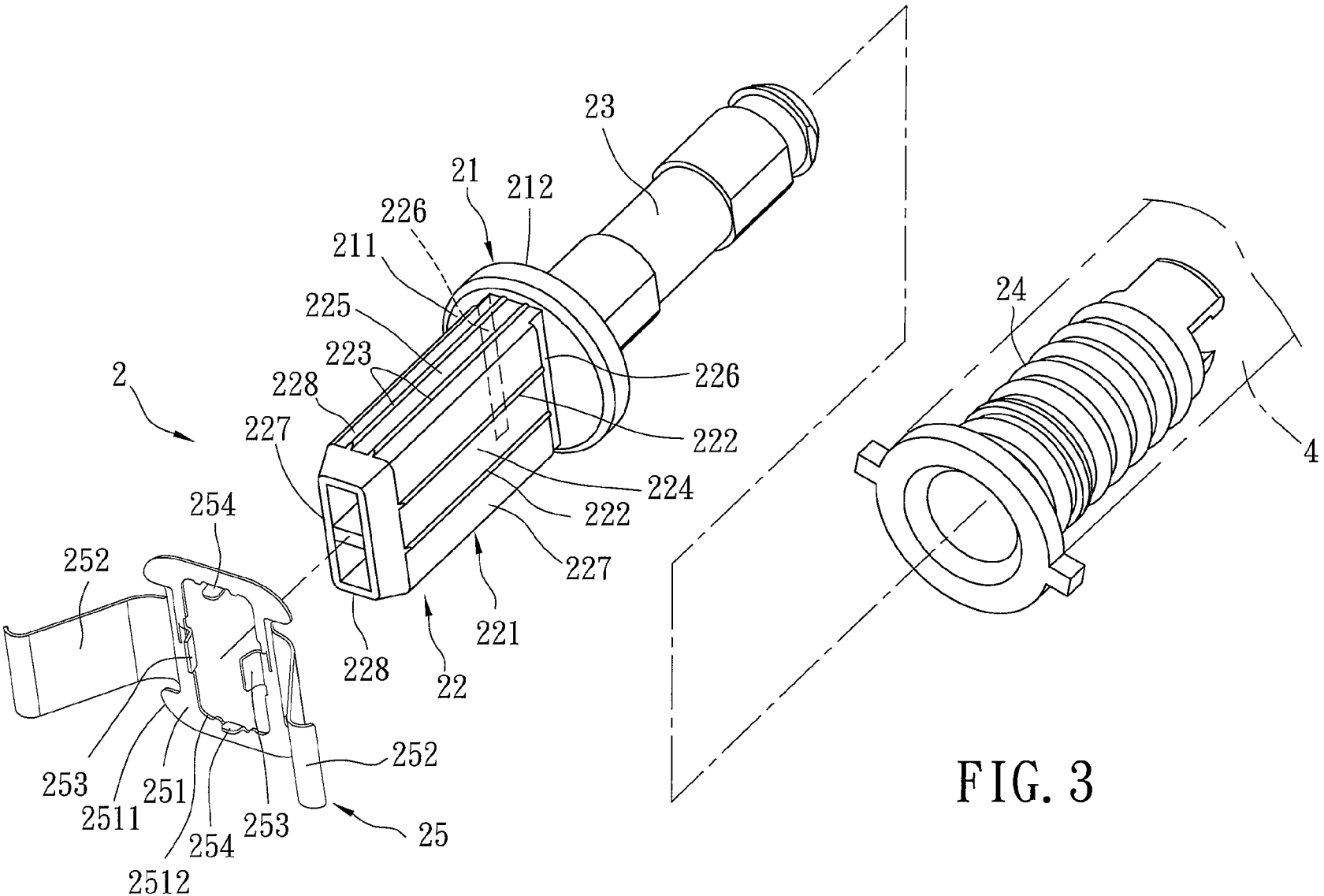
FIG. 3 is an exploded perspective view of a roller rod assembly according to a preferred embodiment of the present invention.
Figure 4:
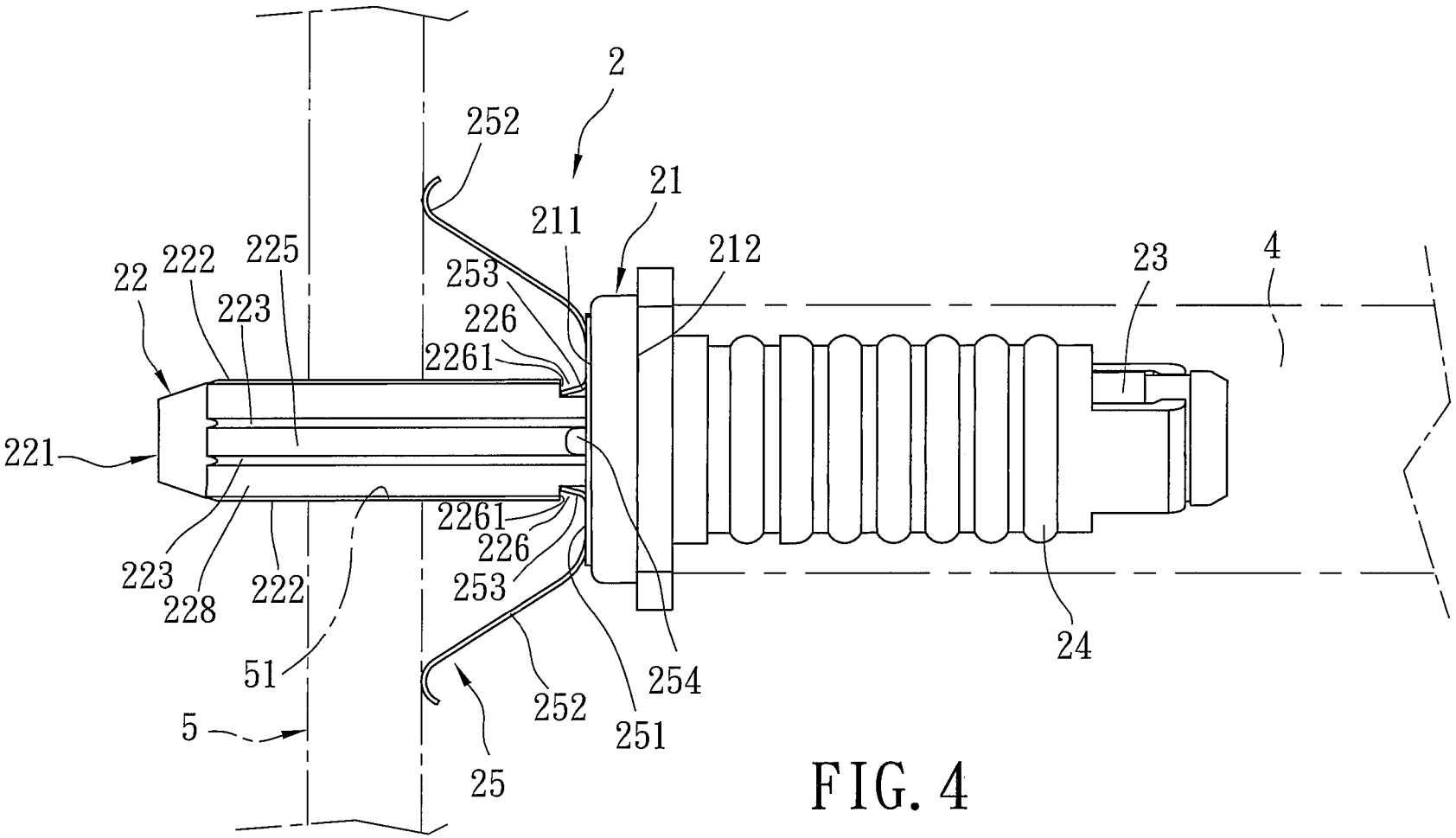
FIG. 4 is a fragmentary schematic side view of the roller rod assembly according to the preferred embodiment of the present invention to illustrate the roller rod assembly in an assembled state.

Referring to FIGS. 3 and 4, a preferred embodiment of a roller rod assembly according to the present invention is shown to comprise a rod 4 and a support unit 2.

The support unit 2 is disposed on an end portion of the rod 4, and includes an end cover 21, a fixing pillar 22, a support pillar 23, an inserting tube 24, and a metallic brace member 25.

The end cover 21 covers the end portion of the rod 4, and has an outer surface 211 and an inner surface 212. The fixing pillar 22 extends from the outer surface 211 of the end cover 21. The support pillar 23 extends from the inner surface 212 of the end cover 21 and into the rod 4. The inserting tube 24 is sleeved rotatably on the support pillar 23, and is inserted fixedly into the rod 4. The metallic brace member 25 is sleeved removably on the fixing pillar 22.

The fixing pillar 22 includes a rectangular pillar body 221, two pairs of first strips 222, and two pairs of second strips 223.

The rectangular pillar body 221 has a pair of opposing wide faces 227 and a pair of opposing narrow faces 228 (only one wide face 227 and one narrow face 228 appears in FIG. 3, and only one narrow face 228 appears in FIG. 4). The wide faces 227 are formed respectively with grooves 226 at a location adjacent to the outer surface 211 of the end cover 21 to thereby form abutment surfaces 2261 opposing the outer surface 211.

Each pair of the first strips 222 is formed along a length of a respective one of the wide faces 227 of the pillar body 221 to thereby cooperate to define a first guide slot 224. An end portion of the first guide slot 224 is immediately adjacent to the corresponding groove 226.

Each pair of the second strips 223 is formed along a length of a respective one of the narrow faces 228 of the pillar body 221 to thereby cooperate to define a second guide slot 225.

The metallic brace member 25 includes a ring portion 251, two wing portions 252, two engaging portions 253, and two abutting portions 254.

The ring portion 251 has an outer circumferential surface 2511 and an inner circumferential surface 2512, and is sleeved removably on the fixing pillar 22 and abutted against the outer surface 211 of the end cover 21.

Each of the wing portions 252 extends from the outer circumferential surface 2511 of the ring portion 251 in a direction away from the support pillar 23.

Proximal ends of the wing portions 252 of the brace member 25 are located in proximity respectively to the wide faces 227 of the pillar body 221 when the ring portion 251 of the brace member 25 is sleeved on the fixing pillar 22.

The engaging portions 253 extend from the inner circumferential surface 2512 of the ring portion 251, can slide respectively along the first guide slots 224 during assembly, and are disposed respectively in the grooves 226 to abut respectively against the abutment surfaces 2261.

The abutting portions 254 extend from the inner circumferential surface 2512 of the ring portion 251, can slide respectively along the second guide slots 225 during assembly, and abut against the narrow faces 228 of the pillar body 221 in the second guide slots 225.

In this embodiment, a width of each of the first guide slots 224 is at least as large as a width of each of the engaging portions 253, and a width of each of the second guide slots 225 is at least as large as a width of each of the abutting portions 254. This configuration allows the engaging portions 253 to slide respectively along the first guide slots 224 during assembly, and the abutting portions 254 to slide respectively along the second guide slots 225 during assembly, as described above.

Therefore, when the metallic brace member 25 is sleeved on the fixing pillar 22, the engaging portions 253 and the abutting portions 254 must be aligned respectively with the first guide slots 224 and the second guide slots 225, after which the engaging portions 253 and the abutting portions 254 are slid therealong. The ring portion 251 is moved toward the end cover 21 until the engaging portions 253 slide away from the first guide slots 224 and into the grooves 226. Consequently, the ring portion 251 abuts against the end cover 21, such that the metallic brace member 25 is able to be sleeved on the fixing pillar 22 in a secure manner.

Figure 1:
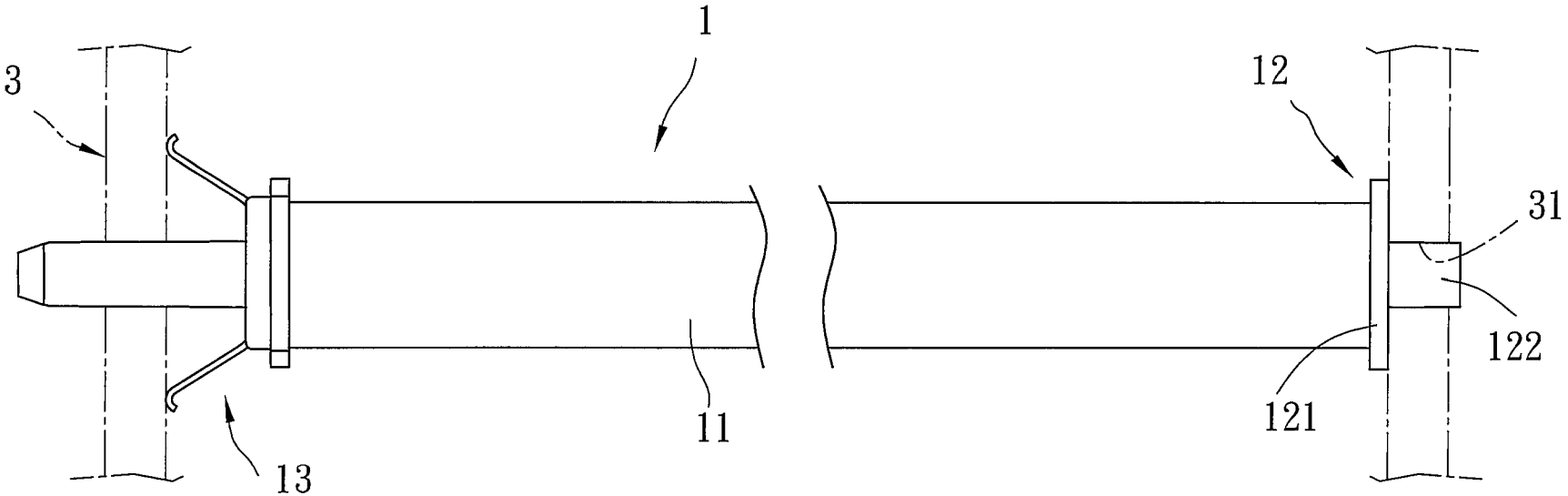
FIG. 1 PRIOR ART
FIG. 1 is a side view of a conventional roller rod assembly.
Figure 2:
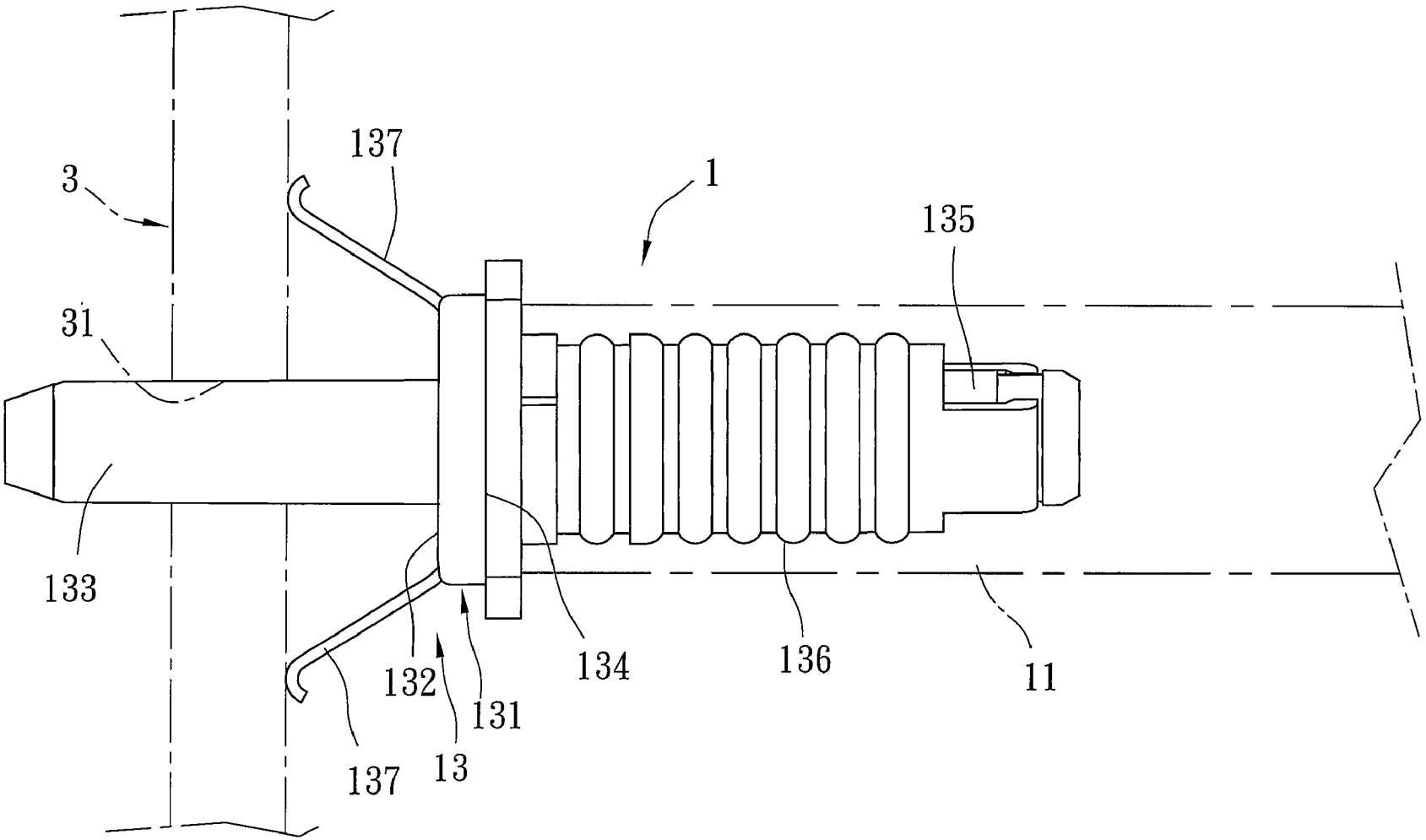
FIG. 2 PRIOR ART
FIG. 2 is a fragmentary schematic side view of the conventional roller rod assembly to illustrate an axial pillar and an inserting tube thereof.

During assembly of the roller rod assembly, the end portion of the rod 4 is first sleeved fixedly on the inserting tube 24, and the other end portion (not shown) of the rod 4 is provided with the support component 12 (see FIG. 1). In some embodiments, the inserting tube 24 is fixedly or removably screw-coupled to the rod 4. Next, the support pillar 23 is inserted into the inserting tube 24. Finally, the roller rod assembly is mounted to a frame 5. The fixing pillar 22 is inserted into a hole 51 of the frame 5 so that the wing portions 252 of the metallic brace member 25 abut against the frame 5.

Pulling down and rolling up a curtain member (not shown) mounted to the rod 4 will result in rotation of the rod 4 and the inserting tube 24 relative to the support pillar 23. During such pulling down on and rolling up of the curtain member, the wing portions 252 can effectively alleviate and absorb the axial forces generated during this process. It is to be noted that the wing portions 252 can be used under various temperature conditions without losing their ability to absorb such axial forces, such that the curtain member can be pulled down and rolled up freely. Furthermore, because the metallic brace member 25 is sleeved removably on the fixing pillar 22, the metallic brace member 25 can be individually replaced or repaired if it becomes damaged, thereby minimizing repair costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A roller rod assembly for a sunshade, comprising:

a rod; and a support unit disposed on an end portion of said rod and including an end cover having an outer surface and an inner surface, a fixing pillar extending from said outer surface of said end cover and including a rectangular pillar body having a pair of opposing wide faces and a pair of opposing narrow faces, said wide faces being formed respectively with grooves at a location adjacent to said outer surface of said end cover to thereby form abutment surfaces opposing said outer surface, a support pillar extending from said inner surface of said end cover and into said rod, an inserting tube sleeved rotatably on said support pillar, and inserted fixedly into said rod, and a metallic brace member including a ring portion having an inner circumferential surface and an outer circumferential surface and that is sleeved removably on said fixing pillar and abutted against said outer surface of said end cover, two wing portions each of which extends from said outer circumferential surface of said ring portion in a direction away from said support pillar, and two engaging portions that extend from said inner circumferential surface of said ring portion and that are disposed respectively in said grooves to abut respectively against said abutment surfaces.

2. The roller rod assembly as claimed in claim 1, wherein said fixing pillar further includes two pairs of first strips, each pair of said first strips being formed along a length of a respective one of said wide faces of said pillar body to thereby cooperate to define a first guide slot an end portion of which is immediately adjacent to said groove.

3. The roller rod assembly as claimed in claim 2, wherein a width of each of said first guide slots is at least as large as a width of each of said engaging portions.

4. The roller rod assembly as claimed in claim 1, wherein said fixing pillar further includes two pairs of second strips, each pair of said second strips being formed along a length of a respective one of said narrow faces of said pillar body to thereby cooperate to define a second guide slot, said brace member further including two abutting portions extending from said inner circumferential surface of said ring portion and abutting against said narrow faces of said pillar body in second guide slots.

5. The roller rod assembly as claimed in claim 4, wherein a width of each of said second guide slots is at least as large as a width of each of said abutting portions.

* * * * *